US008210518B2

(12) United States Patent
Suzuki

(10) Patent No.: US 8,210,518 B2
(45) Date of Patent: Jul. 3, 2012

(54) SHEET-SUPPLYING DEVICE, IMAGE FORMING APPARATUS AND IMAGE FORMING SYSTEM USING THE SAME DEVICE

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/784,044

(22) Filed: May 20, 2010

(65) Prior Publication Data

US 2010/0295238 A1 Nov. 25, 2010

(30) Foreign Application Priority Data

May 25, 2009 (JP) ..... 2009-125086

(51) Int. Cl.
*B65H 3/14* (2006.01)

(52) U.S. Cl. ..... 271/97; 271/98

(58) Field of Classification Search ..... 271/97, 271/98, 103, 90
See application file for complete search history.

(56) References Cited

U.S. PATENT DOCUMENTS 6,015,146 A * 1/2000 Siegel ..... 271/98
6,497,404 B1 * 12/2002 Horii et al. ..... 271/9.13
7,568,691 B2 * 8/2009 Matsumoto ..... 271/97
2002/0145246 A1 * 10/2002 Goda et al. ..... 271/98
2006/0170145 A1 * 8/2006 Nakane ..... 271/97
2009/0146363 A1 * 6/2009 Hosoi ..... 271/9.01
2010/0148419 A1 * 6/2010 Suzuki ..... 271/3.11

FOREIGN PATENT DOCUMENTS

JP 2006-327716 A 12/2006

* cited by examiner

*Primary Examiner* — Stefanos Karmis
*Assistant Examiner* — Patrick Cicchino
(74) *Attorney, Agent, or Firm* — Cantor Colburn LLP

(57) ABSTRACT

A sheet-supplying device, including: a sheet stacking plate on which plural sheets are stacked; an air-suction sheet conveying mechanism which draws up a sheet and conveys the sheet; an air-suction detecting sensor which detects that the air-suction sheet conveying mechanism has drawn up the sheet; a floating-air blowing section which blows air against side edges of the sheets stacked on the sheet stacking pate to float the sheet; and a control section which controls the floating-air blowing section to conduct a sheet supplying operation, wherein the control section selects a first sheet supplying mode or a second sheet supplying mode, based on at least one of: information of a size of the sheets; information of a thickness of the sheets, and information of a type of the sheets.

15 Claims, 10 Drawing Sheets

SHEET-SUPPLYING DEVICE, IMAGE FORMING APPARATUS AND IMAGE FORMING SYSTEM USING THE SAME DEVICE

CROSS REFERENCE TO RELATED APPLICATION

This application is based on Japanese Patent Application No. 2009-125,086 filed on May 25, 2009 with the Japanese Patent Office, the entire content of which is hereby incorporated by reference.

TECHNICAL FIELD

The present invention relates to a sheet-supplying device, in which while air is blown against the lateral edges of stacked sheets, several of the top sheets are float on air, whereby a single sheet is drawn up through a suction surface of a sheet drawing up and conveying mechanism, structured of a sheet conveying belt or the like, and to an image forming apparatus and an image forming system, employing the same sheet-supplying device.

BACKGROUND ART

In recent years, air-suction sheet-supplying device has been used in image forming apparatuses, such as copy machines, printers, or the like, so that the sheets are supplied at high speed. In the air-suction sheet-supplying device, air is blown against the lateral edge of the stacked sheets, so that the sheets float, after that, a single sheet is separated from the floated sheets, and is supplied to a next section.

Unexamined Japanese Patent Application Publication 2006-327,716 discloses an air-suction sheet-supplying device, in which air is blown against the lateral edge of the stacked sheets, so that the top sheets are made to float, whereby the sheets are separated from each other. When a sheet supplying roller supplies the sheet, said sheet is easily separated from the floated sheets.

Generally, image forming apparatuses have been configured to employ various sheets, concerning the size, thickness, and type. Accordingly, the sheet-supplying devices, to be combined to the image forming apparatuses, have been required to exhibit an ability to stably supply the various sheets as needed to the image forming apparatuses.

After the inventor had studied the air-suction sheet-supplying device, the inventor understood that when various sizes of sheets or the various thicknesses of sheets are supplied from the air-suction sheet-supplying device to the image forming apparatus, the capability of floating the sheets varies depending on the size or thickness of the sheets. That is, specific sheets could be floated and supplied as desired, other sheets could not be floated, nor supplied to the image forming apparatus, which resulted in malfunction of the air-suction sheet-supplying device.

Concerning the conventional air-suction sheet-supplying technology, the malfunction, occurred due to the size or thickness of the sheets, has not been studied by manufacturers. Further, the above described patent document does not show a method to overcome said malfunction.

An object of the present invention is to solve said malfunction of the air-suction sheet-supplying device, and to offer a sheet-supplying device, an image forming apparatus, and an image forming system, in which various sheets can be stably conveyed.

SUMMARY OF THE INVENTION

To achieve at least one of the abovementioned objects, a sheet-supplying device reflecting one aspect of the present invention includes: a sheet stacking plate which stacks plural sheets, an air-suction sheet conveying mechanism which draws up a sheet and conveys the sheet; an air-suction detecting sensor which detects that the air-suction sheet conveying mechanism has drawn up the sheet; a floating-air blowing section which blows air against side edges of the sheets stacked on the sheet stacking pate to float the sheet; and a control section which controls the floating-air blowing section to conduct a sheet supplying operation; wherein the control section selects a first sheet supplying mode or a second sheet supplying mode, based on at least one of information of a size of the sheets; information of a thickness of the sheets, and information of a type of the sheets, wherein the first sheet supplying mode functions in such a way that when the air-suction detecting sensor detects that no sheet has been drawn up by the air-suction sheet conveying mechanism, the control section activates the floating-air blowing section to float the sheet and conduct the sheet supplying operation, and the second sheet supplying mode functions in such a way that the control section activates the floating-air blowing section to float the sheet at each supplying operation of the individual sheets.

The sheet-supplying device further includes a sheet detecting sensor which detects the sheet to be conveyed, wherein in the second sheet supplying mode, the control section activates the floating-air blowing section to float the individual sheets, based on a sheet detecting signal sent from the sheet detecting sensor.

The sheet-supplying device, wherein the control section controls the air-suction sheet conveying mechanism to start operation, based on the sheet-suction detecting signal sent from the sheet suction detecting sensor.

The sheet-supplying device further includes a separation air blowing section which blows air against the sheets floated from the sheet stacking plate, so that the floated sheets are individually separated from each other, wherein the control section controls the floating-air blowing section and the separation air blowing section to blow the separation air as well as the floating air.

The sheet-supplying device further includes a conveying mechanism, mounted on a downstream of the suction conveying mechanism, with respect to a sheet conveying direction.

The sheet-supplying device further includes an information generating section which generates at least one of sheet size information, sheet thickness information, and sheet type information, wherein the control section selects the first sheet-supplying mode or the second sheet-supplying mode, based on the information sent from the information generating section.

BRIEF DESCRIPTIONS OF THE DRAWINGS

Embodiments will now be detailed, by way of example only, with reference to the accompanying drawings which are meant to be exemplary, not limiting, and wherein like embodiments are numbered alike in the several figures, in which.

DETAILED DESCRIPTIONS OF THE PREFERRED EMBODIMENTS

Figure 1:
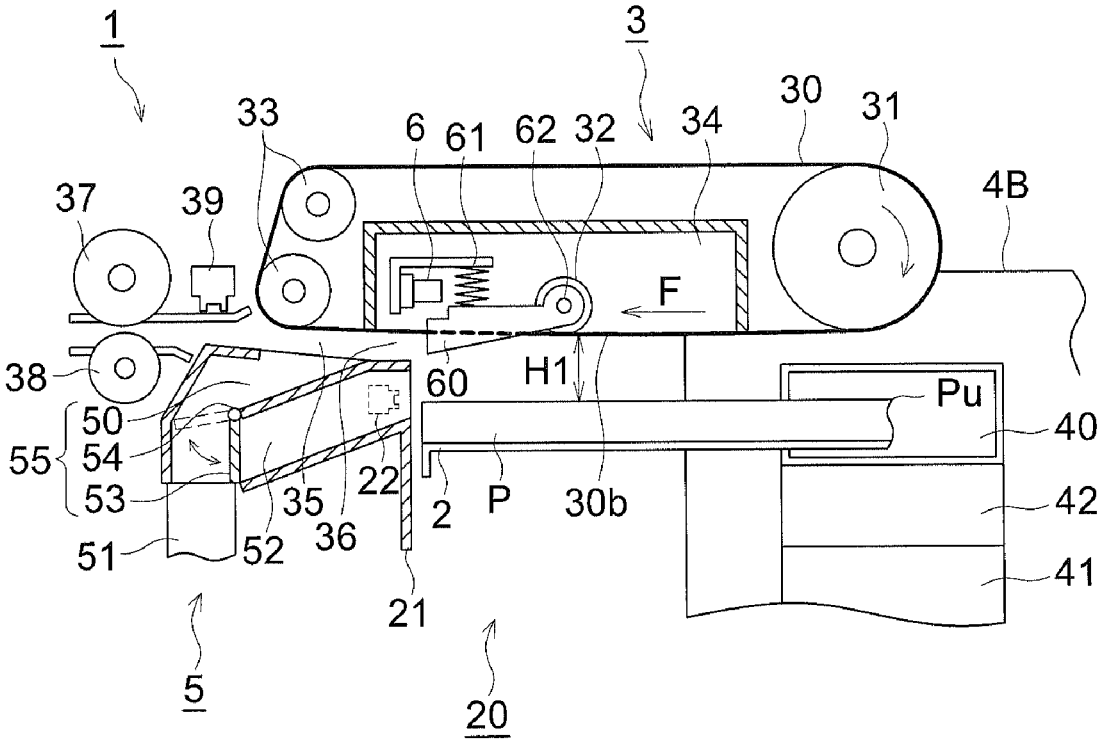
FIG. 1 is a side view to show a structure of sheet-supplying device 1 of the present invention.

Embodiments of the present invention will now be detailed while referring to the drawings, however, the present invention is not limited to the embodiments to be detailed below.

<Structure of Sheet-Supplying Device>

Figure 2:
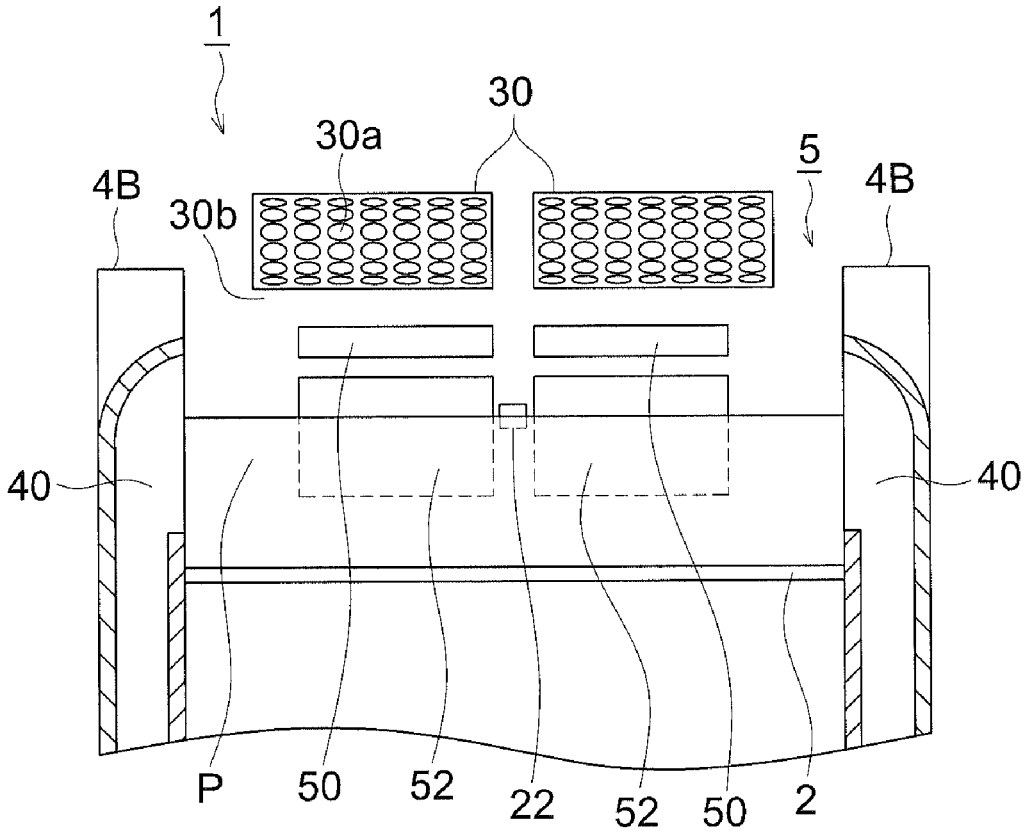
FIG. 2 is a front view to show a structure of sheet-supplying device 1.
Figure 3:
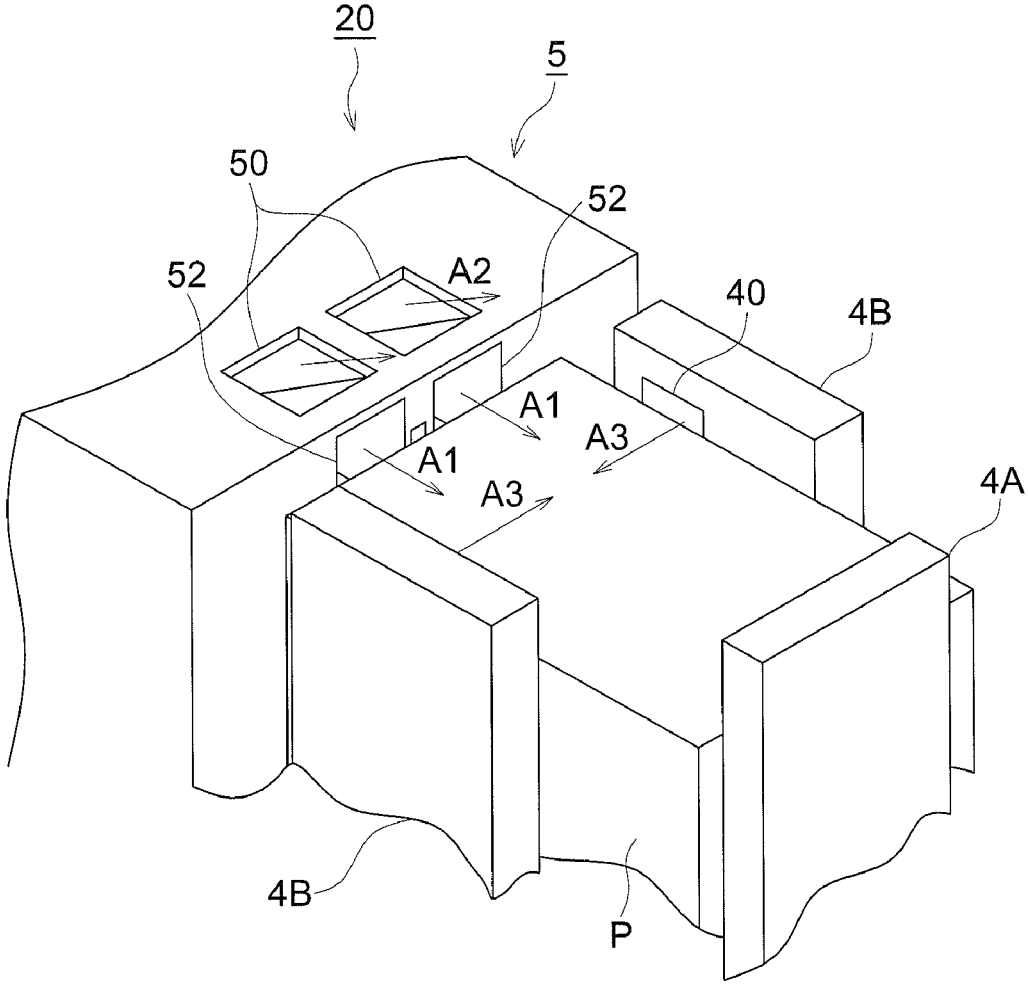
FIG. 3 is a perspective view to show a structure of sheet accommodating section 20.

FIG. 1 is a side view to show a structure of sheet-supplying device 1 of the present invention, FIG. 2 is a front view to show a structure of sheet-supplying device 1, and FIG. 3 is a perspective view to show a structure of sheet accommodating section 20.

As shown in FIGS. 1-3, sheet-supplying device 1 includes sheet suction-conveying mechanism 3 which draws up a top sheet of plural sheets P accommodated on sheet stacking plate 2, and conveys said sheet P, trailing end regulating member 4A which is movable in a conveying direction of sheet P shown by arrow F, and pushes the trailing ends of sheets P, accommodated on sheet accommodating plate 2, to regulate the trailing ends of sheets P; and lateral edge regulating members 4B which are movable in a lateral direction of sheet P, being perpendicular to sheet conveying direction F, and push the lateral edges of sheets P, accommodated on sheet stacking plate 2, to align the lateral edges of sheets P.

Further, sheet-supplying device 1 includes a sheet floating/separation air blowing mechanism (hereinafter, referred to as "air blowing mechanism 5") which blows auxiliary floating air A1 against the leading ends of sheets P, through an auxiliary floating air outlet (hereinafter, referred to as "air outlet 52"), to float sheets P, and blows separation air A2 against sheet P, drawn up by sheet suction-conveying mechanism 3, through a separation air outlet (hereinafter, referred to as "air blowing mechanism 5"), mounted to face the leading ends of sheets P; and air blow switching mechanism 55 which switches air, blown from air blowing mechanism 5, to air outlet 50 or air outlet 52.

Still further, sheet-supplying device 1 includes sheet accommodating section 20 having a space to accommodate stacked sheets P, as a predetermined number, in which sheet stacking plate 2 is included. Sheet stacking plate 2 is elevated in a direction to stack sheets P, by an elevating mechanism, which is not illustrated. Sheet accommodating section 20 includes sheet stopping surface 21 to regulate the position of the leading ends of sheets P to be stacked on sheet stacking plate 2, wherein sheet stopping surface 21 is formed parallel to an elevating direction of sheet stacking plate 2.

Still further, sheet-supplying device 1 includes upper limit detecting sensor 22 which detects upper-most surface Pu of stacked sheets P on sheet stacking plate 2. Upper limit detecting sensor 22 is structured of paired optical sensors, arranged on sheet stopping surface 21 in a stacking direction of sheets P. Upper limit detecting sensor 22 is arranged at a position on which upper-most surface Pu of stacked sheets P on sheet stacking plate 2 exists within distance H1 in which suction/conveying mechanism 3 can draw up sheet P. When no sheet P exists within distance H1, sheet suction-conveying mechanism 3 sends an "OFF" signal, and when sheet P exists within distance H1, sheet suction-conveying mechanism 3 sends an "ON" signal. H1 represents a distance between a suction surface of suction conveying mechanism 3 and upper-most surface Pu of stacked sheets P.

After a certain number of sheets P have been supplied, and when the height of stacked sheets P on sheet stacking plate 2 decreases to a predetermined height, sheet stacking plate 2 is elevated upward, until upper limit detecting sensor 22 detects upper surface position Pu. Accordingly, upper surface position Pu is controlled to be within distance H1, whereby sheet suction conveying mechanism 3 can draw up sheet P.

Sheet suction conveying mechanism 3, which draws up a sheet and conveys the sheet, includes conveying belt 30 mounted on an upper area of sheet accommodating section 20, drive roller 31 about which conveying belt is entrained, first driven roller 32 and second driven roller group 33 having two driven rollers. Conveying belt 30, which is part of structure of a suction means to draw up sheet P, represents an endless belt. Air suction holes 30*a*, which penetrate conveying belt 30, are arranged in the lateral direction of conveying belt 30, and also arranged over the entire area of conveying belt 30. Drive roller 31 has a shaft which is perpendicular to conveyance direction F of sheet P, drive roller 31 is driven by a motor, which will be detailed later. First driven roller 32 and second driven paired roller group 33 have separate shafts, being nearly parallel to the shaft of drive roller 31, so that they are driven by the rotation of conveying belt 30 driven by drive roller 31.

Suction conveying mechanism 3 includes second driven roller group 33, above sheet stopping surface 21, and at a downstream area of sheet stopping surface 21 in conveying direction F of sheet P. Further, drive roller 31 is mounted above sheet stacking plate 2. Still further, first driven roller 32 is mounted between second driven roller group 33 and drive roller 31, above sheet stacking plate 2. Conveying belt 30 is entrained about drive roller 31 and driven roller group 33, being parallel to the conveying direction of sheet P. Accordingly, conveying belt 30 and various rollers bridge across sheet stopping surface 21, and conveying belt 30 runs in direction F. Conveying belt 30 is structured of two endless belts, both arranged parallel, in the lateral direction, being perpendicular to the conveying direction of sheet P. When drive roller 31 is rotated in an arrowed direction, each conveying belt 30 rotates so that surfaces of belt 30 facing sheet stacking plate 2 move in the conveying direction of sheet P shown by arrow F. The lowest point of the circumferential surface of drive roller 31 is nearly the same height as that of first driven roller 32, while the lowest point of the circumferential surface of a lower-positioned roller of second driven roller group 33 is higher, at a predetermined height, than that of first driven roller 32. Accordingly, the surface of conveying belt 30, facing sheet stacking plate 2, between drive roller 31 and first driven roller 32 is nearly parallel to the surface of sheet P stacked on sheet stacking plate 2. The surface of conveying belt 30, between first driven roller 32 and second driven roller group 33, is slanted toward the conveying direction of sheet P. The surface of conveying belt 30 on first drive roller 32 is curved.

Sheet suction conveying mechanism 3 includes suction chamber 34, to receive air coming through conveying belt 30. That is, suction chamber 34 is formed within conveying belt 30, so that air enters said chamber through plural air suction holes 30*a* of conveying belt 30. Since air pressure becomes negative in chamber 34, suction surface 30*b* of conveying belt 30 draws up sheets P Still further, sheet-supplying device 1 includes sheet conveying path 35 to convey sheet P, drawn up by suction conveying mechanism 3. Sheet conveying path 35 includes guide members to guide sheet P, drawn up by suction conveying mechanism 3 and conveyed, whereby entrance 36, which sheet P enters, is formed between conveying belt 30 to face sheet stacking plate 2, and a top of sheet stopping surface 21.

Still further, sheet-supplying device 1 includes drive roller 37, and driven roller 38 driven by drive roller 37, in sheet conveying path 35. Those rollers represent a sheet conveying mechanism to convey sheet P conveyed by suction conveying mechanism 3, which rollers are rotated by a motor, which will be detailed later while referring to FIG. 4.

Sheet-supplying device 1 includes sheet sensor 39 which is mounted in sheet conveying path 35. Sheet sensor 39 is structured of paired optical sensors, whose detecting portions are arranged upstream of drive roller 37 and driven roller 38, whereby said sheet sensor 39 detects sheet P, which has been picked up by suction conveying mechanism 3, and conveyed by conveying rollers, which rollers are structured of drive roller 37 and driven roller 38. When sheet sensor 39 detects the leading end of sheet P, picked up by suction conveying mechanism 3, sheet sensor 39 outputs an "ON" signal, and when the trailing end of sheet P, conveyed by drive roller 37, passes through sheet sensor 39, sheet sensor 39 outputs an OFF signal.

Figure 4:
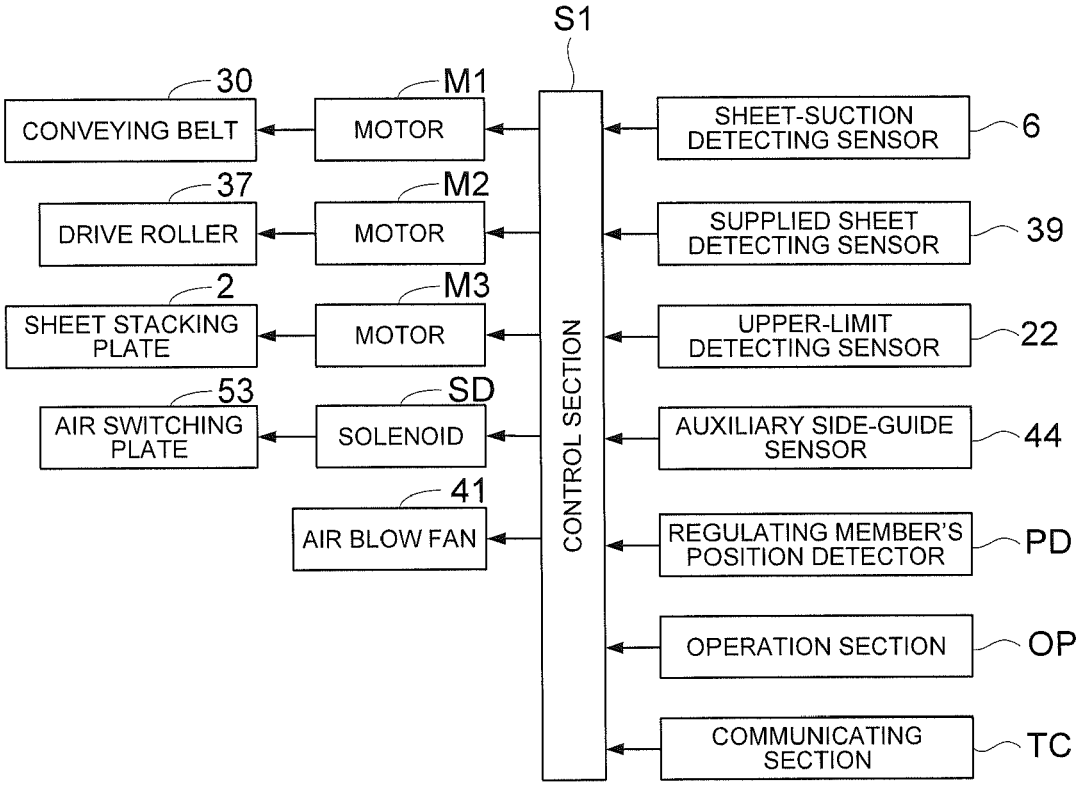
FIG. 4 is a block diagram to show a structure of a control system of sheet-supplying device 1.

In FIG. 1, at a side portion of sheet accommodating section 20, sheet floating air outlet 40 (hereinafter referred to as "air outlet 40") is formed on lateral edge regulation member 4B, whereby air is applied against the lateral edges of sheets P. By lateral edge regulation member 4B, after air is vacuumed by fan 41, air is sent through duct 42 and is blown out from air outlet 40, which air represents "floating air A3". Lateral edge regulation member 4B is movable in the lateral direction, being perpendicular to conveying direction F of sheet P, and the position of lateral edge regulation member 4B is detected by lateral edge regulation member position detector PD (being a detector having a resister to change the position to the electrical voltage, for example), shown in FIG. 4. Trailing end regulation member 4A is movable in conveying direction F of sheet P, and the position of trailing end regulation member 4A is detected by position detector PD of the trailing end regulation member (being a detector having a resister to change the position to the electrical voltage, for example), which is shown in FIG. 4.

In FIG. 1, air blower 5 is structured of air outlet 52 which blows out auxiliary floating air A1, air outlet 50 which blows out separation air A2, and switching mechanism 55 which changes the amounts of air to be blown out from air outlets 52 and 50. Solenoid SD (which is shown in FIG. 4) drives plate 53 pivoted on shaft 54 so that air outlet 50 closes, whereby air drawn up by fan 51 is blown against the leading ends of sheets P through air outlet 52. Auxiliary floating air A1, which is blown out from air outlet 52, and floating air A3, which is blown out from air outlet 40, are horizontally blown against sheets P. Further, solenoid SD (which is shown in FIG. 4) drives plate 53 pivoted on shaft 54 so that air outlet 52 closes, whereby separation air A2 is blown from air outlet 50 against conveying belt 30 at an angle. Separation air A2, blown out from air outlet 50, is directed toward the surface, facing sheet stacking plate 2, of conveying belt 30, whereby separation air A2 is horizontally blown toward sheet P, which sheet is drawn tip by conveying belt 30.

Sheet-supplying device 1 further includes sheet suction sensor 6, which detects whether sheet P is drawn up by conveying belt 30. Sheet suction sensor 6 is structured of paired optical sensors, which detect whether element 60 has been lifted by sheet P, when sheet P is drawn up by conveying belt 30. When sheet P is drawn up by conveying belt 30, an upward force is applied on element 60, protruding from suction surface 30*b* of conveying belt 30. Due to this upward force, element 60 is rotated around shaft 62 against the elastic force of spring 61, so that element 60 returns to suction surface 30*b*. When no sheet is drawn up by conveying belt 30, no upward force is applied on element 60, element 60 is rotated around shaft 62 by the elastic force of spring 61, so that element 60 protrudes from suction surface 30*b*. That is, based on the existence or absence of sheet P on conveying belt 30, element 60 rotates. When no sheet P is drawn up by conveying belt 30, sheet suction detecting sensor 6 outputs an "OFF" signal. While sheet P is drawn up by conveying belt 30, sheet suction detecting sensor 6 outputs the "ON" signal, for example. Based on said signals from sheet suction detecting sensor 6, it is possible for sheet-supplying device 1 to determine whether sheet P is drawn up by conveying belt 30 or not.

During continuous sheet supplying operation, in which plural sheets P are continuously supplied, suction detecting sensor 6 can detect separation of plural sheets P, that is, it can detect discontinuity between each sheet. After a single sheet P is drawn up by conveying belt 30, a subsequent single or plural sheets may be drawn up onto said single sheet P, whereby plural sheets P may be conveyed without discontinuity by conveying belt 30. In this case, suction detecting sensor 6 continuously outputs the "ON" signal. When the separation occurs between a foregoing sheet P and subsequent sheet P, suction detecting sensor 6 outputs the "OFF" signal, so that the trailing end of the foregoing sheet P and the leading end of subsequent sheet P are detected, that is, the discontinuity is detected by suction detecting sensor 6.

As detailed above, suction detecting sensor 6 can detect the separation between plural sheets P in the continuous sheet supplying operation.

<Control System>

FIG. 4 shows a block diagram of the control system of sheet-supplying device 1 relating to the present invention. Sheet-supplying device 1 includes control section S1, which conducts sheet supplying controls to supply sheets P one by one, stacked on sheet stacking plate 2 as shown in FIG. 1, based on the signals outputted from the sensors.

Control section S1 functions as a section of control section S which totally controls the image forming apparatus, such as image formation, to be detailed later.

Control section S1 controls the sheet supplying operation, based on a first sheet-supplying mode or a second sheet-supplying mode.

The first sheet supplying mode works to supply an easily floatable sheet, such as a large sized sheet, while the second sheet supplying mode works to supply a not-easily floatable sheet, such as a small sized sheet. In the first sheet-supplying mode, while a drawn up sheet is detected by suction detecting sensor 6, floating operation is not conducted for each sheet to be supplied. That is, in a case that plural sheets P are drawn up onto conveying belt 30 to be conveyed, since not only an upper most sheet P, but also next upper sheet P is also drawn up by conveying belt 30, subsequent sheets are not necessary to be floated. In this case, if the subsequent sheets are floated, sheets P are not separated individually, and plural sheets P are supplied, whereby sheets P are superimposed, which result in a superimposed jam. In the first sheet-supplying mode, control section S1 conducts sheet floating operation, when suction detecting sensor 6 detects that no sheet has been drawn up.

In the second sheet-supplying mode, which works to supply not-easily floatable sheets, control section S1 controls each section to conduct the sheet floating operation, independently whether suction detecting sensor 6 has detected a drawn up sheet or not. If the sheet floating operation is not conducted on not-easily floatable sheet P, sheet P is not supplied, which results in a no-feed problem.

In FIG. 4, motor M1 drives conveying belt 30, motor M2 drives drive roller 37, motor M3 elevates sheet stacking plate 2, solenoid SD drives switching plate 53 to open air outlet 50 or air outlet 52, detector PD detects the position of trailing end regulating member 4A and the position of lateral edge regulating member 4B, operation section OP works to operate the sheet-supplying device, and communication section TC conducts communication with various external sections, such as personal computer PC.

Operation section OP and communication section TC structures an information generating section to generate sheet-size information to be used in a job. When an image copying operation is conducted, operation section OP generates sheet-size information, based on sheet-size information inputted by the user. In a case that printing operation is conducted by a printing command via a network, communication section TC receives the printing command, and generates sheet-size information.

Image forming apparatus 100 includes plural sheet-supplying devices, each accommodates a given size of sheets. Detector PD outputs electrical voltages corresponding to the position of trailing end regulating member 4A and the position of lateral edge regulating member 4B. Control section S1 determines the size of the sheet, accommodated in each sheet-supplying device, based on the output of detector PD.

Based on sheet-size information sent from operation section OP or communication section TC, control section S1 selects a sheet-supplying device among the plural sheet-supplying devices, wherein the selected sheet-supplying device accommodates the sheets exhibiting the sheet-size instructed by referring to the output of detector PD.

In a copy setting operation, or the printing command, if an automatic sheet supplying operation is instructed, control section S1 determines a size of the sheet, based on a document size and an instructed printing magnification, based on an "automatic" command.

Control section S1 feeds out sheet P from the sheet-supplying device under the first sheet-supplying mode or the second sheet-supplying mode, based on information of the sheet-size sent from operation section OP or communication section TC, both modes will be detailed below.

To conduct the sheet supplying operation, floating air is applied against the lateral edges of sheets P stacked on sheet stacking plate 2, so that plural sheets P representing the plural upper sheets of the stacked sheets P are levitated. The floating air blowing section is structured of air outlet 40, air fan 41, air fan 51, air outlet 52 and switching plate 53. Control section S1 controls solenoid SD to drive switching plate 53, and controls air fan 41, so that the floating air blowing section is desirably controlled by control section S1.

The sheet supplying operation under the first sheet-supplying mode, and the second sheet-supplying mode, plural floating sheets are separated by the separation air. The separation air blowing section is structured of air outlet 50, air fan 51, and switching plate 53. Control section S1 controls solenoid SD to drive switching plate 53, so that the separation air blowing section is desirably controlled by control section S1.

<Operational Example of Sheet-Supplying Device 1>

(First Sheet-Supplying Mode)

Figure 6:
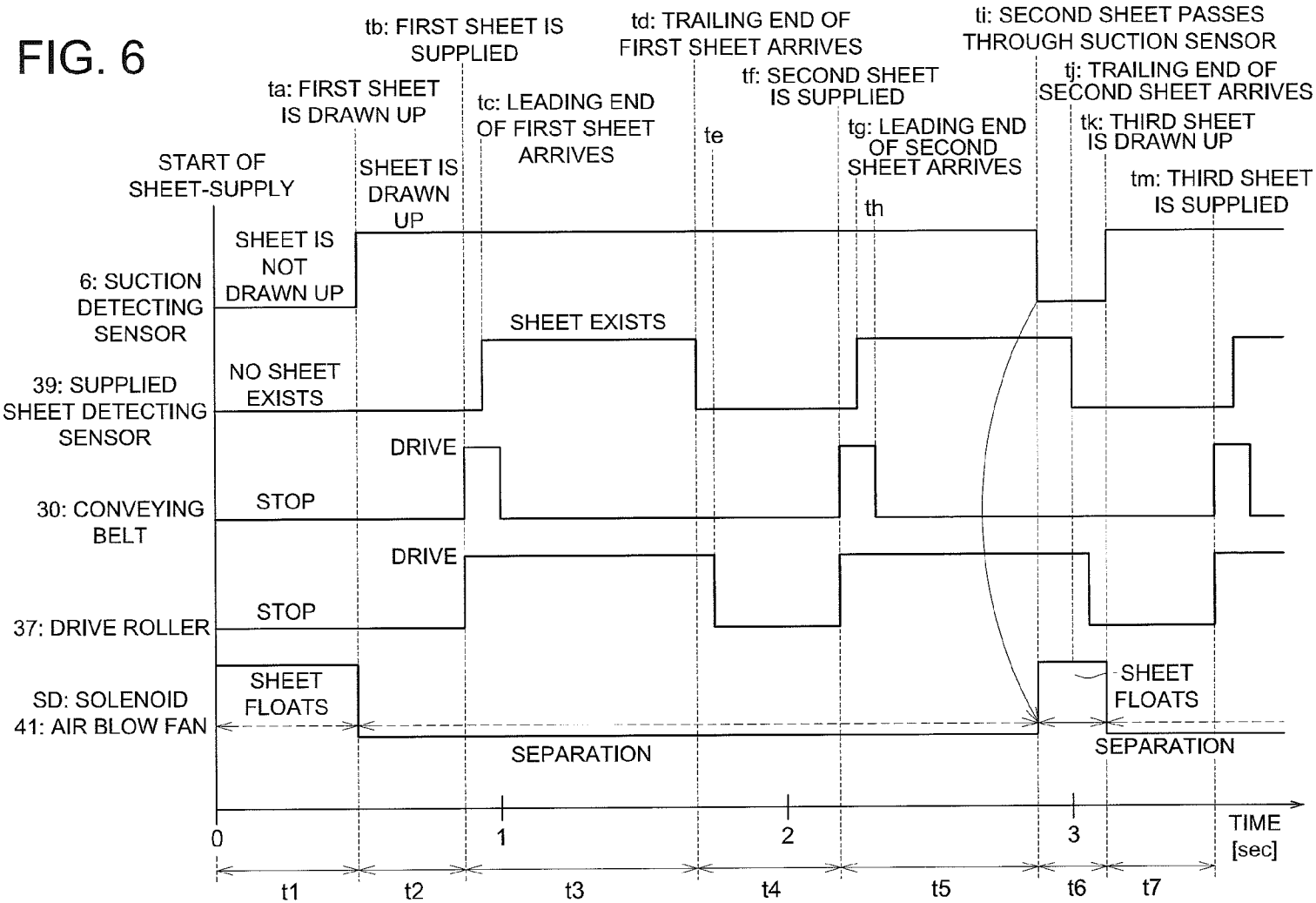
FIG. 6 is a timing chart to show an operation of the first sheet supplying mode.

FIG. 6 shows a time chart of the sheet supplying operations under the first sheet-supplying mode. The first sheet-supplying mode is employed to supply the large sized sheets, greater than B4 size.

A fan (which is not illustrated) to be arranged in suction chamber 34 is activated when the job is started, and continues to run during the job operation. Accordingly, the pneumatic pressure in suction chamber 34 is controlled to be negative during the job operation, which negative pressure is kept to enable to draw up sheet P.

During the preparation step of the sheet supplying operation, based on the output from upper limit detecting sensor 22, control section S1 controls motor M3 to elevate sheet stacking plate 2, so that upper surface position Pu of sheet P, stacked on sheet stacking plate 2, is controlled to come within distance H1, at which it is possible to draw up sheet P.

Figure 5A:
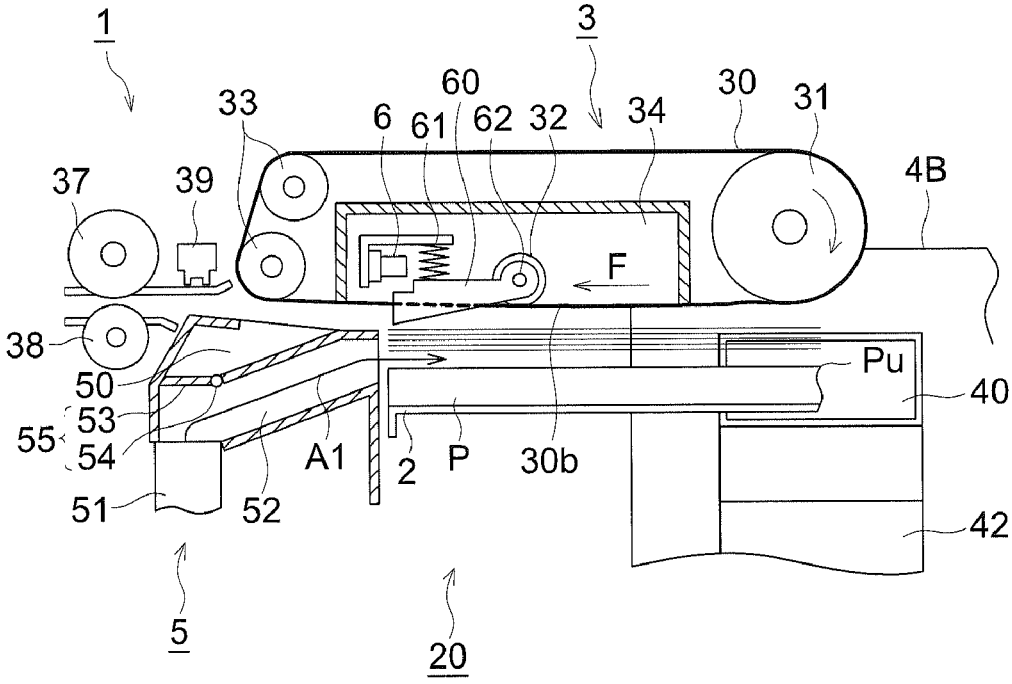
FIGS. 5A and 5B are side views to show an operation of sheet-supplying device 1.

At sheet-supply starting time "START OF SHEET-SUPPLY" in FIG. 6, air fans 41 and 51 are activated so that operations to levitate sheets P are conducted. In sheet floating operation, control section S1 controls solenoid SD of switching mechanism 55, to drive switching plate 53 around shaft 54, whereby air outlet 52 opens, and air outlet 50 closes. FIG. 5A shows air outlet 52 opens as the sheet floating operation. That is, during the sheet floating operation in air blowing mechanism 5, switching plate 53 closes air outlet 50, and air fan 51 is activated to send auxiliary floating air A1 to the leading ends of sheets P stacked on sheet stacking plate 2. Further, air fan 41 is activated to send floating air A3 from air outlet 40 to the lateral edges of sheets P. By air A1 and air A2, the several upper positioned sheets P of plural sheets P stacked on sheet stacking plate 2 begin to float. Time interval "t1" in FIG. 6 represents a waiting time, which is between sheet-supply starting time "START OF SHEET-SUPPLY" and a time point at which floating sheet P is drawn up by conveying belt 30.

Figure 5B:
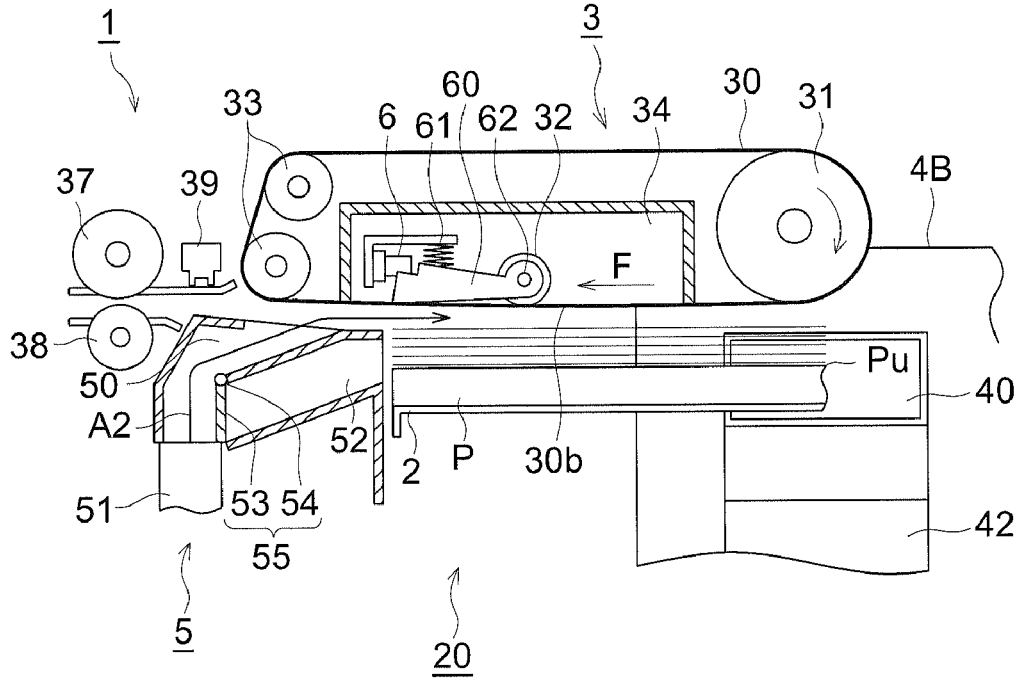

That is, uppermost sheet P stacked on sheet stacking plate 2 is drawn up by conveying belt 30, having suction surface 30*b*, at time "ta" in FIG. 6. After sheet P has been drawn up by conveying belt 30, element 60 of suction detecting sensor 6 is lifted up by the force to draw up sheet P, whereby element 60 is rotated around shaft 62 against spring 61 (See FIG. 5B). At time "ta" in FIG. 6, suction sensor 6 detects sheet P, and outputs an "ON" signal. When sensor 6 outputs the "ON" signal (which represents that a drawn up sheet exists), control section S1 understands that sheet P has been drawn up by conveying belt 30.

Control section S1 controls solenoid SD to rotate air switching plate 53 around shaft 54, whereby air outlet 52 closes and air outlet 50 opens, and air fan 41 is deactivated, so that separating and conveying operation of sheet P starts. The surface of conveying belt 30, said surface faces sheet stacking plate 2, is curved on first driven roller 32, and the surface of conveying belt 30 between first driven roller 32 and second driven rollers 33 is slightly slanted along conveying direction F of sheet P. Due to these surfaces of conveying belt 30, sheet P, drawn up by conveying belt 30, is curved at first driven roller 32.

More than two sheets P may be drawn up by conveying belt 30, due to electrostatic action. Among stacked sheets P, uppermost sheet P, to be drawn up by conveying belt 30, directly receives suction force through conveying belt 30, whereby said uppermost sheet P is drawn up to be shaped along the line of conveying belt 30 entrained about first driven roller 32. However, second or subsequent sheets P, adhered to uppermost sheet P and drawn up by conveying belt 30, is not shaped along the line of conveying belt 30 entrained about first driven roller 32, but uppermost sheet P and second or subsequent sheets P are separated at their leading ends.

During the separating and conveying operation, switching plate closes air outlet 52, whereby separation air A2 flows from air outlet 50. As shown in FIG. 3, separation air A2 is horizontally sent to the leading ends of sheets P drawn up by conveying belt 30. That is, on suction conveying mechanism 3, if more than two sheets P have been drawn up by conveying belt 30, separation air A2 is applied to the leading ends of drawn up sheets P, so that uppermost sheet P only is separated from the second or subsequent sheets P. By this operation, plural sheets P, which are simultaneously drawn up by conveying belt 30, are separated one by one by separation air A2, which can overcome the problem of double-sheets conveyance.

In sheet-supplying device 1 of the present embodiment, before sheet P is drawn up by conveying belt 30, switching plate 53 closes air outlet 50, while after sheet P has been drawn up by conveying belt 30, switching plate 53 closes air outlet 52, so that floating function and separating function can be compatible. However, another method is possible to use in that, switching plate does not entirely close air outlets 50 and 52, and auxiliary floating air A1 and separation air A2 can be variable. That is, before suction sensor 6 detects drawn up sheet P, auxiliary floating air A1 is strongly applied, and after suction sensor 6 detects drawn up sheet P, auxiliary floating air A1 is weakly applied.

Time "t2" in FIG. 6 represents a separation waiting time, during which sheets P are separated from each other by separation air A2 and floating air A3, after sheets P have been drawn up by conveying belt 30 at time "ta", with sensor 6 outputting the "ON" signal.

Based on the signal, showing that sheet P has been drawn up by conveying belt 30, sent from suction detecting sensor 6, control section S1 activates motor M1 to drive conveying belt 30 of suction conveying mechanism 3 at time "tb", which is after predetermined separation waiting time t2, and also activates motor M2 to rotate drive roller 37, so that sheet P is started. When drive roller 31 is rotated in the arrowed direction, conveying belt 30 is driven, whereby the surface of conveying belt 30 facing sheet stacking plate 2 moves in arrow direction F. Due to this movement, sheet P, drawn up by conveying belt 30 in suction conveying mechanism 3, is conveyed in arrowed direction F. During this conveying operation of sheet P, since separation air A2 is continuously blown from air blowing mechanism 5, secondary and subsequent sheets P, which have been separated from first sheet P, are forced to return to sheet accommodating section 20. Due to this, secondary sheet P2 is prevented from following to first sheet P1, so that secondary sheet P2 is not conveyed to sheet entrance 36.

Sheet P is drawn up by suction conveying mechanism 3, and fed out by conveying belt 30. The leading end of said sheet P is advanced to a detecting position of sheet sensor 39 at time "tc", wherein sheet sensor 39 outputs the "ON" signal (which shows an existence of sheet P), that is, sheet P is detected. After the leading end of sheet P has reached sheet sensor 39, conveying belt 30 further rotates at a predetermined time interval, then the leading end of sheet P is nipped between drive roller 37 and driven roller 38. After control section S1 understands that sheet sensor 39 has output the "ON" signal at time "tc", and the leading end of sheet P has reached sheet sensor 39, and a predetermined time has passed, conveying belt 30 is stopped, however, drive roller 37 still rotates. The predetermined time interval, which is between the time when sheet sensor 39 outputs the "ON" signal and the time when conveying belt 30 stops, is determined, based on a time interval which is between a time when sheet sensor 39 outputs the "ON" signal and the time when drive roller 37 and driven roller 38 nip sheet P. At time "t3", sheet P, which is nipped between drive roller 37 and driven roller 38, is conveyed. While sheet P is conveyed, suction conveying mechanism 3 continues to draw up sheet P, that is, conveying belt 30 draws up sheet P with the suction force. Conveying forces, generated by drive roller 37 and driven roller 38, are greater than said suction force, accordingly, sheet P is conveyed by drive roller 37 and driven roller 38, while conveying belt 30 does not rotate. After sheet P is conveyed by drive roller 37 and driven roller 38, the trailing end of sheet P passes through suction detecting sensor 6. After the trailing end of sheet P has passed through suction detecting sensor 6, if subsequent sheet P is not drawn up, element 60 of suction detecting sensor 6 moves so that the output of suction detecting sensor 6 changes to the "OFF" signal (which shows no sheet P is drawn up).

Further, when sheet P is conveyed by drive roller 37 and driven roller 38, the trailing end of sheet P passes through sheet sensor 39, so that the output of sheet sensor 39 changes to the "OFF" signal (which shows no sheet P at time "td"). When control section S1 receives said OFF signal from sheet sensor 39, control section S1 controls drive roller 37 not to rotate (which is at time "te"). To supply second sheet P2, conveying belt 30 and drive roller 37 are activated at time "tf".

As detailed above, first sheet P is supplied at starting time "START OF SHEET-SUPPLY", however, second and subsequent sheets P are supplied at two cases, one case is that those sheets P are supplied without being detected by suction detecting sensor 6, and the other case is that those sheets P are supplied after being detected by suction detecting sensor 6, which are detailed below. To supply second and subsequent sheets P, plural sheets P are not separated from each other, but are drawn up by conveying belt 30, whereby each sheet P may not be detected individually by suction detecting sensor 6. FIG. 6 shows that second sheet P2 is not detected individually, that is, suction detecting sensor 6 continues to output the "ON" signal, and that third sheet P3 is detected individually, that is, the output from suction detecting sensor 6 changes from the "ON" signal to the "OFF" signal, and from the "OFF" signal to the "ON" signal.

At time "tf", being the time in which separation waiting time "t4" has passed after the trailing end of first sheet P1 was detected by sheet sensor 39, conveying belt 30 and drive roller 37 are activated so that second sheet P2 is fed out. In this sheet supplying operation, no signal from suction detecting sensor 6 is used. Second sheet P2 is conveyed while being drawn up by conveying belt 30, and not separated from first sheet P1. At time "th", conveying belt 30 is stopped so that second sheet P2 is separated from first sheet P1. At time "t5", second sheet P2 is conveyed by drive roller 37. Accordingly, no floating air is applied on second sheet P2 to supply second sheet P2.

When the trailing end of second sheet P2 has passed through suction detecting sensor 6, third sheet P3 is not drawn up by conveying belt 30. Accordingly, at time "ti", suction detecting sensor 6 outputs the "OFF" signal, and suction detecting sensor 6 detects the trailing end of second sheet P2. Further, after suction detecting sensor 6 detects the trailing end of second sheet P2, sheet sensor 39 detects the trailing end of second sheet P2 at time "tj". After suction detecting sensor 6 detects the trailing end of second sheet P2, switching plate 53 is moved to cover air outlet 50, so that auxiliary floating air A1 is blown from air outlet 52 at time "ti", and air blow fan 41 is activated at time "t6", so that the sheet floating operation is conducted.

After sheet sensor 39 detects the trailing end of second sheet P2, drive roller 37 is stopped so that the supplying operation of second sheet P2 is terminated. At time "t6", floated third sheet P3 is drawn up by conveying belt 30, and at time "tk", suction detecting sensor 6 detects third sheet P3 as drawn up. After separation waiting time "t7" has passed since third sheet P3 was detected, conveying belt 30 and drive roller 37 are activated at time "tm", so that third sheet P3 is conveyed. Fourth and subsequent sheets P are supplied by the same way as detailed above.

(Second Sheet-Supplying Mode)

Figure 7:
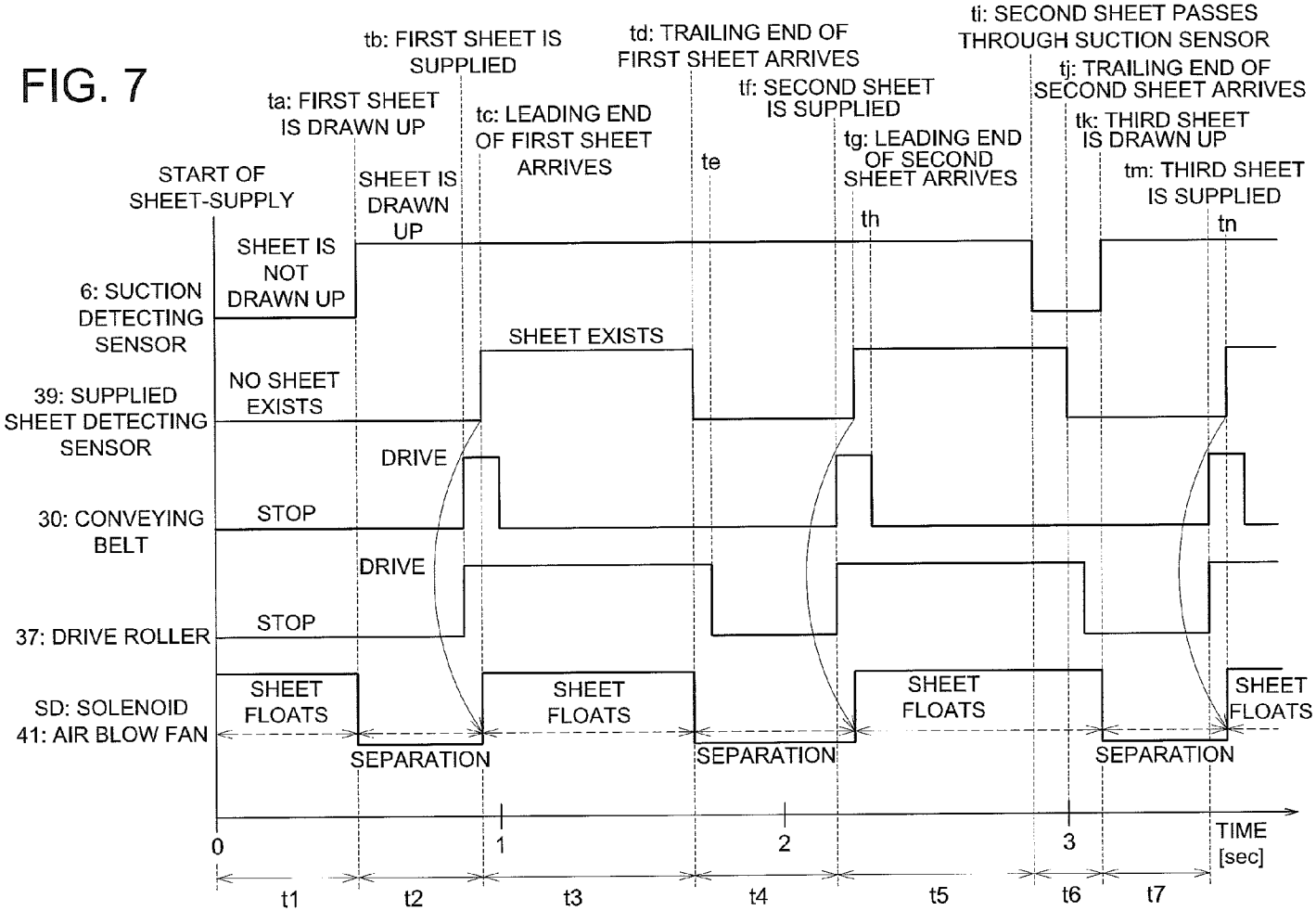
FIG. 7 is a timing chart to show an operation of the second sheet supplying mode.

The operation of sheet supplying device 1 under the second sheet supplying mode will now be detailed while referring to FIG. 7. Since various sections, having the same name and numeral as in the explanations of FIGS. 5A and 5B, and FIG. 6, have the same function in FIG. 7, their explanations are omitted.

FIG. 7 is a time chart to convey small sized sheets, such as A4S size, in which the short side of A4 sheet is parallel to the sheet conveying direction.

In FIG. 7, conveying belt 30 and drive roller 37 convey first sheet P1 at times "tb" and "tc", second sheet P2 at times "tf" and "tg", and third sheet P3 at times "tm" and "tn", which are the same as the case of the first sheet-supplying mode shown in FIG. 6. However, in the second sheet-supplying mode shown in FIG. 7, floating air A3 from air outlet 40, and auxiliary floating air A1 from air outlet 52 are applied on first sheet P1, second sheet P2, and third sheet P3, which differ from the case of the first sheet-supplying mode. That is, first sheet P1 begins to float at starting time "START OF SHEET-SUPPLY", second sheet P2 begins to flat at time "tc", and third sheet P3 begins to float at time "tg".

Concerning the first sheet floating operation at starting time "START OF SHEET-SUPPLY", air outlet 52 is controlled to be open by the sheet-supply starting signal, as detailed above, and air blow fan 41 is activated so that the sheet begins to float. Concerning the second sheet floating operation at time "tc", based on the signal showing that the leading end of first sheet P1 has been detected by sheet sensor 39, air outlet 52 is controlled to open, and air blow fan 41 is controlled to activate, so that second sheet P2 begins to float. That is, the second sheet floating operation is started at time "tc", based on the detecting signal of the leading end of first sheet P1, which is independent to whether suction detecting sensor 6 detects second sheet P2. The floating operation at time "tg" is started, based on the signal showing that the leading end of preceding second sheet P2 has been detected by sheet sensor 39, which is the same way as in the case of the floating operation at time "tc". The trailing end of third sheet P3 is detected by suction detecting sensor 6 at time "ti". Concerning fourth sheet P4, the detection of the trailing end at time "ti" is not used. That is, fourth sheet P4 is floated, based on the signal from sheet sensor 39 at time "tn". Accordingly, in the case of the small sized sheet supplying operation detailed in FIG. 7, the subsequent sheet is floated, based on the detection signal of the leading end of the preceding sheet, whereby the floating operation is conducted for individual sheets. By this method, the small sized sheets, being difficult to float, can be exactly supplied.

In the embodiments detailed above, sheets which are equal to or greater than B4 size are grouped as large sized sheets, and sheets which are equal to or less than A4S size are grouped as small sized sheets, whereby the first sheet-supplying mode or the second sheet-supplying mode is selected, based on the size of the sheet.

Since floating of a sheet depends upon the thickness of the sheet and the type of sheet, it is possible for the user to select a sheet supplying mode, based on the thickness of the sheet and the type of the sheet. The thickness of the sheet and the type of the sheet to be used in the job are selected by the user for the image copying operation, wherein the user inputs information of the thickness of the sheet and information of the type of the sheet through operation section OP. When the printing operation is conducted by a printing command through the network, communication section TC receives the printing command, and generates information of the thickness of the sheet and information of the type of the sheet.

Since thick sheets are more difficult to float, when a sheet supplying mode is selected based on the thickness of sheet, the first sheet-supplying mode is selected for the sheets exhibiting less than 128 g/m$^2$ of the basis weight, while the second sheet-supplying mode is selected for the sheets exhibiting the basis weight which is greater than or equal to 128 g/m$^2$.

Further, coated sheets are more difficult to float than regular sheets. Accordingly, the sheet-supplying mode is selected based on the type of the sheet, that is, the first sheet-supplying mode is selected to supply regular sheets, and the second sheet-supplying mode is selected to supply coated sheets.

A matrix can be structured including factors, such as the size of the sheet, the thickness of the sheet, and the type of the sheet, whereby the first sheet-supplying mode and the second sheet-supplying mode are allocated on each factor of the matrix, so that a desired sheet-supplying mode is selected. Said matrix results in the generation of the stable sheet-supplying device.

Various examples for combining the above described factors are listed below.

a) For large sized sheets, such as sheets of B4 size, and sheets greater than B4 size, the first sheet-supplying mode is selected, independent of the thickness of sheets and the type of sheets, while for the small sized sheets, such as sheets of A4 size, and sheets less than A4 size, the second sheet-supplying mode is selected, independent of the thickness of sheets and the type of sheets.

b) For sheets less than 128 g/m$^2$ of basis weight, the first sheet-supplying mode is selected independent of the size of sheets and the type of sheets, while for the sheets greater than or equal to 128 g/m$^2$ of basis weight, the second sheet-supplying mode is selected independent of the size of sheets and the type of sheets.

c) For sheets other than coated sheets, the first sheet-supplying mode is selected independent of the size of sheets and the thickness of sheets, while for the coated sheets, the second sheet-supplying mode is selected independently to the size of sheets and the thickness of sheets.

<Structure of Sheet Supplying Device 90>

Figure 8:
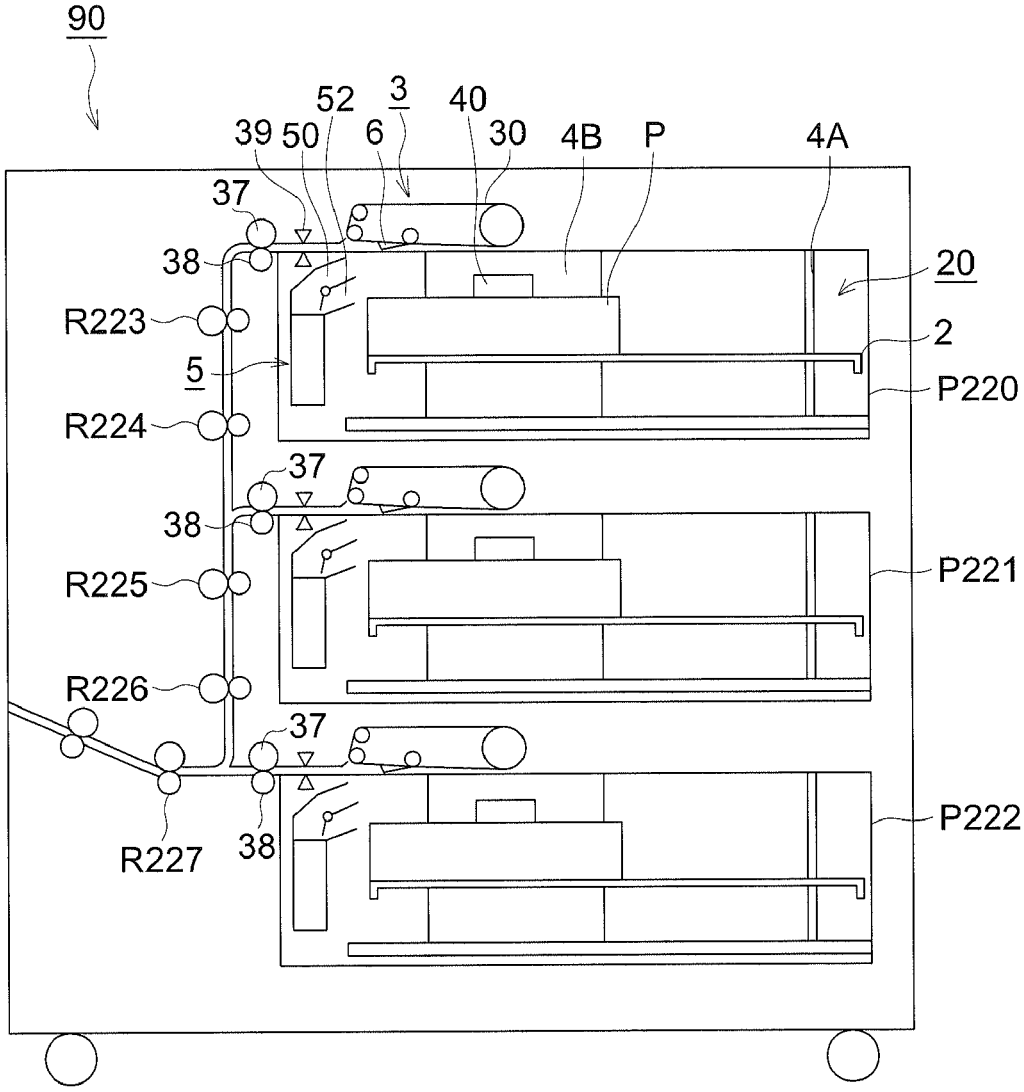
FIG. 8 shows structure 90 of the sheet-supplying device.

Sheet supplying device 90 of the present invention will now be detailed, while referring to FIG. 8. Sheet supplying device 90, shown in FIGS. 1-7, incorporates plural sheet supplying devices 1, detailed above, as sheet supplying units.

In FIG. 8, sheet supplying device 90 has three sheet supplying devices P220, P221, and P222 in the vertical direction. Further, suction conveying mechanisms 3, including conveying belt 30 shown in FIG. 1, are provided on each of sheet supplying devices P220, P221, and P222. Still further, on the sides of sheet supplying devices P220, P221, and P222, air outlets 40 are provided to blow air against the lateral edges of sheets P stacked on sheet supplying devices P220, P221, and P222. Still further, lateral edge regulating members 4B are provided to regulate the lateral edges of sheets P, and trailing end regulating members 4A are provided to regulate sheets P in the sheet conveying directions.

Auxiliary floating air is applied against the leading ends of sheets P, stacked on sheet supplying devices P220, P221, and P222, from air outlet 52 facing the leading ends of sheets P. A blowing mechanism 5 is provided to blow separation air between uppermost sheet P, and second and subsequent sheets P. Sheet supplying devices P220, P221, and P222 are provided to be drawn, in the depth direction of FIG. 8, from image forming apparatus 100, after the operator opens a front door, provided on a front side of FIG. 8, but not illustrated. In addition, the front surfaces of sheet supplying devices P220, P221, and P222 may be structured as front panels having knobs, whereby the operator can use knobs to draw and insert sheet supplying devices P220, P221, and P222. The supplying direction of sheet P on suction conveying mechanism 3 is perpendicular to the drawing direction of sheet supplying devices P220, P221, and P222 (that is, sheet P is supplied toward the left on FIG. 8). Sheets P, to be drawn up by conveying belt 30 of suction conveying mechanism 3, are individually separated by the floating air coming through air outlet 40, the auxiliary floating air coming through air outlet 52, and the separation air coming through air outlet 50. Sheet P, to be conveyed from sheet supplying device P220 by suction conveying device 3, is nipped by paired drive rollers 37 and driven roller 38, wherein the nipping portion of said paired rollers is positioned at nearly the same height as the lower surface of conveying belt 30, entrained about driven roller 33, being a lower roller of second driven roller group 33, shown in FIG. 1.

Sheet P, nipped by drive roller 37 and driven roller 38, is conveyed by drive roller 37, and directed downward by the guide member. After sheet P has been conveyed by conveying rollers R223-R226, structuring a vertical sheet conveying path, sheet P is horizontally guided to the left by the guide member in FIG. 8, whereby the leading end of sheet P is stopped by paired conveying rollers R227, which rollers are under a stopped condition. After that, said paired conveying rollers R227 are controlled to rotate, so that sheet P is sent to image forming apparatus 100. Paired conveying rollers R227 function as the paired registration rollers to synchronize with the image forming process of image forming apparatus 100, which will be detailed below. In the same way as the case of sheet supplying device 220, sheet P, to be conveyed from sheet supplying device P221 by suction conveying mechanism 3, is nipped by paired drive roller 37 and driven roller 38, wherein the nipping portion of said paired rollers is positioned at nearly the same height as the lower surface of conveying belt 30, entrained about a lower roller of second driven roller group 33, shown in FIG. 1. Sheet P, nipped by drive roller 37 and driven roller 38, is conveyed by drive roller 37, and directed downward by the guide member. After sheet P has been conveyed downward by conveying rollers R225 and R226, sheet P is horizontally guided to the left by the guide member in FIG. 8, whereby the leading end of sheet P is stopped by paired conveying rollers R227, which rollers are under the stopped condition. After that, said paired conveying rollers R227 are controlled to rotate, so that sheet P is sent to image forming apparatus 100.

Further, in the same way as the case of sheet supplying device 220, sheet P, to be conveyed from sheet supplying device P222 by suction conveying mechanism 3, is nipped by paired drive roller 37 and driven roller 38, wherein the nipping portion of said paired rollers is positioned at nearly the same height as the lower surface of conveying belt 30, entrained about driven roller 33, being a lower roller of second driven roller group 33, shown in FIG. 1. Sheet P, nipped by drive roller 37 and driven roller 38, is conveyed by drive roller 37, and directed downward by the guide member. After sheet P has been conveyed downward by conveying rollers 8225 and 8226, sheet P is horizontally guided to the left by the guide member in FIG. 8, whereby the leading end of sheet P is stopped by paired conveying rollers 8227, which rollers are under the stopped condition. After that, said paired conveying rollers 8227 are controlled to rotate, so that sheet P is sent to image forming apparatus 100.

Sheet supplying unit 90 relating to the present embodiment incorporates above-mentioned sheet supplying device 1, various types of sheets P are effectively drawn up during the sheet supplying operation, and an abnormal conveyance of plural sheets P is prevented, that is, plural sheets P are not drawn up by the suction surface at the same time.

<Structure of Image Forming Apparatus 100>

Image forming apparatus 100 relating to the present invention will now be detailed. Image forming apparatus 100, shown in FIGS. 1-7, includes above-detailed sheet supplying device 1. Image forming apparatus 100 represents a digital full-color image copying machine, structured of image forming section 104 and image reading device 101. Image forming apparatus 100 further includes sheet supplying section 80, having the above-described sheet supplying device, image fixing section 80, and control section S. Image forming section 104 is referred to as a tandem-type full color image forming section, structured of image forming units 10Y, 10M, 10C and 10K, and image transfer unit 70. Image reading device 101 is structured of automatic document feeding device 102 and scanning exposure device 103, each mounted above image forming section 104. Original document 7, placed on a document platen of automatic document feeding device 102, is conveyed by a conveying section which is not illustrated, whereby after images of a single surface or both surfaces have been scanned to be exposed by an optical system of scanning exposure device 103, said scanned images are read out by line image sensor 8, structured of CCD and the like. Image data, photo-electrically converted by line image sensor 8, are processed, regarding an analog process, an A/D conversion, a shading correction, and an image compressing process. After that, said processed image data is sent to exposure sections 3Y, 3M, 3C, and 3K.

Image forming unit 10Y, which is configured to form yellow images, includes charging section 2Y, exposure section 3Y, development section 4Y, primary transfer section 5Y, and cleaning section 6Y, around cylindrical photosensitive drum 1Y. Image forming unit 10M, which is configured to form magenta images, includes charging section 2M, exposure section 3M, development section 4M, primary transfer section 5M, and cleaning section 6M, around cylindrical photosensitive drum 1M. Image forming unit 10C, which is configured to form cyan images, includes charging section 2C, exposure section 3C, development section 4C, primary transfer section 5C, and cleaning section 6C, around cylindrical photosensitive drum 1M. Image forming unit 10K, which is configured to form black images, includes charging section 2K, exposure section 3K, development section 4K, primary transfer section 5K, and cleaning section 6K, around cylindrical photosensitive drum 1K. When color image data is inputted in image forming apparatus 100, image forming units 10Y, 10M, 10C, and 10K respectively form single color toner images, and when monochromatic image data is inputted in image forming apparatus 100, image forming unit 10K forms black toner images. Transfer unit 70 is structured of intermediate transfer belt 71, secondary transfer section 72, drive roller 73, and belt cleaning section 74.

Intermediate transfer belt 71 is entrained about plural rollers, including drive roller 73, and is supported by rotatable plural rollers. Intermediate transfer belt 71 is sandwiched and pressed by photosensitive drums 1Y, 1M, 1C, and 1K, and primary transfer sections 5Y, 5M, 5C, and 5K. The toner images, formed on photosensitive drums 1Y, 1M, 1C, and 1K, are successively transferred to intermediate transfer belt 71, whereby a full-color toner image is formed on intermediate transfer belt 71.

Sheet supplying section 80 is structured of sheet supplying sections P10, P11, and P12, sheet supplying rollers 81 and 81A, and paired registration rollers 82. Sheet supplying devices P10 and P11 have sheet supplying roller 81A to individually separate sheets P, and convey separated sheet P. Sheet supplying device P12 represents sheet supplying device 1 which has been detailed above, while referring to FIGS. 1-7. Sheet supplying device P12 separates plural sheets P by suction conveying mechanism 3, and convey separated sheets P one by one. Sheets P accommodated in sheet supplying devices P10, P11, P12 are picked up one by one from one of sheet supplying devices P10, P11, and P12. Said sheet P is conveyed by sheet supplying rollers 81, to paired registration rollers 82, which are in a no-rotating condition. Sheet P is stopped by paired registration rollers 82. When the position of full-color toner image comes to correspond with the leading end of sheet P, paired registration rollers 82 are controlled to rotate, whereby sheet P is supplied to secondary transfer section 72, and the full-color toner image is transferred onto sheet P. After that, any remaining toner particles on intermediate transfer belt 71 are removed by belt cleaning section 74.

Image fixing section 77 is structured of fixing roller 78 and pressure applying roller 79. Sheet P, carrying the transferred toner image is heated and pressed at a nipping section which is formed by fixing roller 78 and pressure applying roller 79, so that the toner image is fixed on sheet P. After that, sheet P carrying the fixed image is ejected to sheet ejection tray 84 by paired ejection rollers 83.

Control section S, including CPU to conduct arithmetic controls, ROM to store various programs, and RAM to store various data, conducts total control of the image forming processes. Control section S controls switching mechanism 55 of sheet supplying device 1, based on suction sensor 6, sheet sensor 39 and auxiliary side guide sensor 44, detailed referring to FIG. 1.

Image forming apparatus 100 relating to the present embodiment incorporates above-mentioned sheet supplying device 1, various types of sheets P are effectively drawn up during the sheet supplying operation, and an abnormal conveyance of plural sheets P is prevented, that is, plural sheets P are not drawn up by the suction surface at the same time.

The above detailed technology is applied on the full color image forming apparatuses, however said technology can be applied on monochromatic image forming apparatuses.

<Structure of Image Forming System 110>

Figure 9:
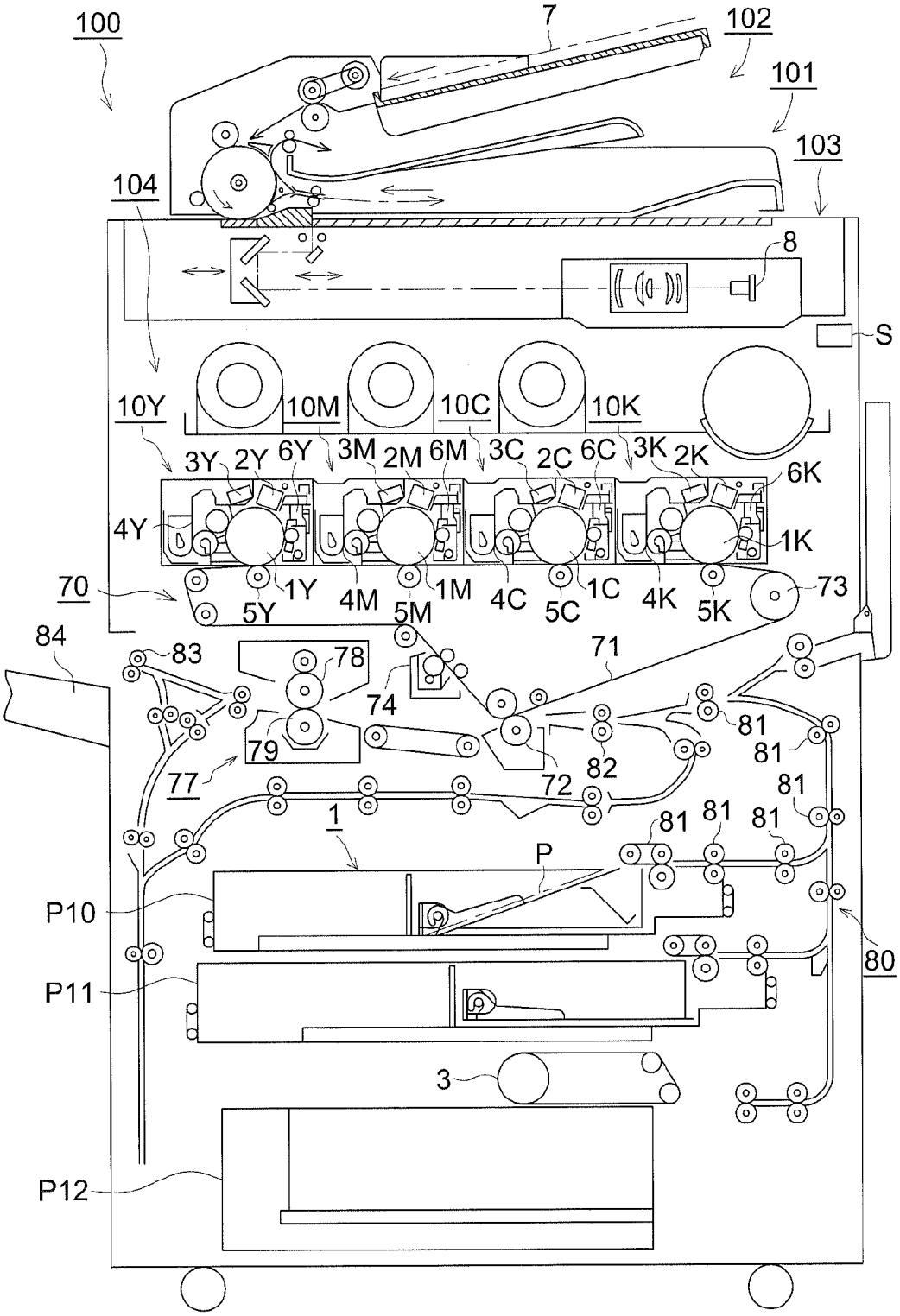
FIG. 9 shows a structure of image forming apparatus 100.
Figure 10:
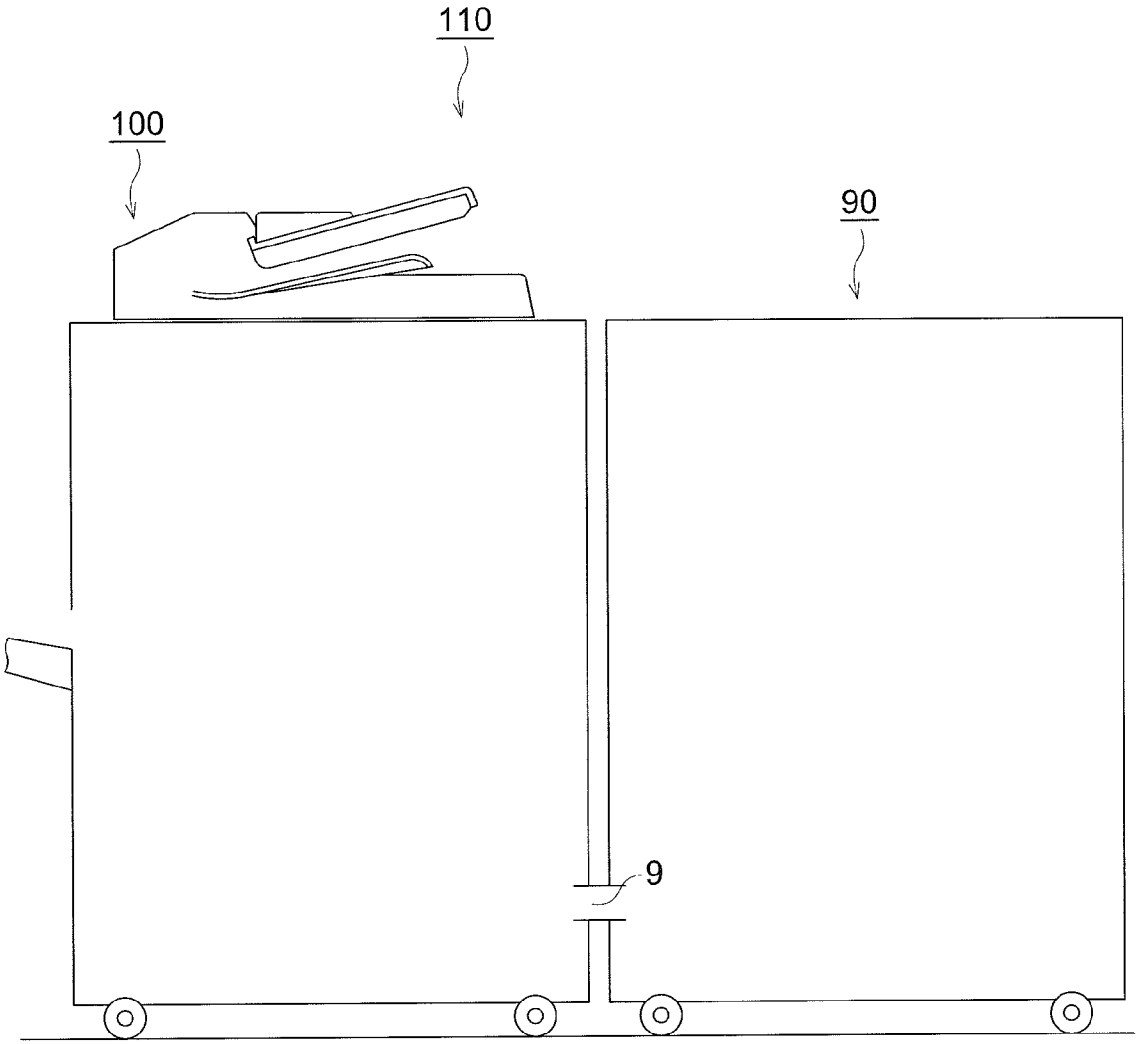
FIG. 10 shows a structure of image forming system 110.

Image forming system 110 relating to an embodiment of the present invention will now be detailed while referring to FIG. 10. Image forming system 110 includes image forming apparatus 100 and sheet supplying device 90. Sheet supplying device 90 is shown in FIG. 9. Sheet P, which has been separated by sheet supplying device 90, is conveyed to image forming apparatus 100 through passage 9. After the various processes are conducted on sheet Pin image forming apparatus 100, sheet P is ejected to a tray mounted on an external section of image forming apparatus 100. Since image forming system 110 relating to the present embodiment includes image forming apparatus 100 and sheet supplying device 90, various types of sheets P are effectively drawn up during the sheet supplying operation, and an abnormal conveyance of plural sheets P is prevented, that is, plural sheets P are not drawn up by the suction surface at the same time.

What is claimed is:

1. A sheet-supplying device, comprising:

a sheet stacking plate on which plural sheets are stacked;

an air-suction sheet conveying mechanism which draws up a sheet and conveys the sheet;

an air-suction detecting sensor which detects that the sheet has been drawn up by the air-suction sheet conveying mechanism;

a floating-air blowing section which blows air against side edges of the sheets stacked on the sheet stacking pate to float the sheet; and a control section which controls the floating-air blowing section to conduct a supplying operation of the sheet;

wherein the control section selects a first sheet supplying mode or a second sheet supplying mode, based on at least one of information of a size of the sheets;

wherein the air-suction sheet conveying mechanism is actuated; and information of a thickness of the sheets, and information of a type of the sheets, wherein the first sheet supplying mode functions in such a way that when the air-suction detecting sensor detects that no sheet has been drawn up by the air-suction sheet conveying mechanism, the control section activates the floating-air blowing section to float the sheet and to conduct the supplying operation of the sheet, and the second sheet supplying mode functions in such a way that the control section activates the floating-air blowing section to float the sheet at each supplying operation of the individual sheets.

2. The sheet-supplying device of claim 1; further comprising a sheet detecting sensor which detects the sheet to be conveyed, wherein in the second sheet supplying mode, the control section activates the floating-air blowing section at each supplying operation of the individual sheets, based on a sheet detecting signal sent from the sheet detecting sensor.

3. The sheet-supplying device of claim 1, wherein the control section controls the air-suction sheet conveying mechanism to start operation, based on the sheet-suction detecting signal sent from the sheet suction detecting sensor.

4. The sheet-supplying device of claim 1, further comprising a separation air blowing section which blows air against the sheets floated from the sheet stacking plate, so that the floated sheets are individually separated from each other, wherein the control section controls the floating-air blowing section and the separation air blowing section to blow the separation air followed by the floating air.

5. The sheet-supplying device of claim 1, further comprising a conveying mechanism, mounted on a downstream of the suction conveying mechanism, with respect to a sheet conveying direction.

6. The sheet-supplying device of claim 1, further comprising an information generating section which generates at least one of a sheet size information, a sheet thickness information, and a sheet type information, wherein the control section selects the first sheet-supplying mode or the second sheet-supplying mode, based on the information sent from the information generating section.

7. The sheet-supplying device of claim 6, wherein the information generating section includes at least one of an operation section of the image forming apparatus and a communicating section of the image forming apparatus.

8. An image forming apparatus, comprising:

a sheet-supplying device, comprising:

a sheet stacking plate on which plural sheets are stacked;

an air-suction sheet conveying mechanism which draws up a sheet and conveys the sheet;

an air-suction detecting sensor which detects that the air-suction sheet conveying mechanism has drawn up the sheet;

a floating-air blowing section which blows air against side edges of the sheets stacked on the sheet stacking pate to float the sheet; and a control section which controls the floating-air blowing section to conduct a sheet supplying operation;

wherein the control section selects a first sheet supplying mode or a second sheet supplying mode, based on at least one of:

information of a size of the sheets;

information of a thickness of the sheets, and information of a type of the sheets, wherein the air-suction sheet conveying mechanism is actuated; and wherein the first sheet supplying mode functions in such a way that when the air-suction detecting sensor detects that no sheet has been drawn up by the air-suction sheet conveying mechanism, the control section activates the floating-air blowing section to float the sheet and to conduct the sheet supplying operation, and the second sheet supplying mode functions in such a way that the control section activates the floating-air blowing section to float the sheet at each supplying operation of the individual sheets; and an image forming section which forms images on the sheet which is sent from the sheet-supplying device.

9. The image forming apparatus of claim 8, further comprising a sheet detecting sensor which detects the sheet to be conveyed, wherein in the second sheet supplying mode, the control section activates the floating-air blowing section at each supplying operation of the individual sheets, based on a sheet detecting signal sent from the sheet detecting sensor.

10. The image forming apparatus of claim 8, wherein the control section controls the air-suction sheet conveying mechanism to start operation, based on the sheet-suction detecting signal sent from the sheet suction detecting sensor.

11. The image forming apparatus of claim 8, further comprising a separation air blowing section which blows air against the sheets floated from the sheet stacking plate, so that the floated sheets are individually separated from each other, wherein the control section controls the floating-air blowing section and the separation air blowing section to blow the separation air followed by the floating air.

12. The image forming apparatus of claim 8, further comprising a conveying mechanism, mounted on a downstream of the suction conveying mechanism, with respect to a sheet conveying direction.

13. The image forming apparatus of claim 8, further comprising an information generating section which generates at least one of a sheet size information, a sheet thickness information, and a sheet type information, wherein the control section selects the first sheet-supplying mode or the second sheet-supplying mode, based on the information sent from the information generating section.

14. The image forming apparatus of claim 13, wherein the information generating section includes at least one of an operation section of the image forming apparatus and a communicating section of the image forming apparatus.

15. An image forming system, comprising a sheet-supplying device, comprising:

a sheet stacking plate on which plural sheets are stacked;

an air-suction sheet conveying mechanism which draws up a sheet and conveys the sheet;

an air-suction detecting sensor which detects that the air-suction sheet conveying mechanism has drawn up the sheet;

a floating-air blowing section which blows air against side edges of the sheets stacked on the sheet stacking pate to float the sheet; and a control section which controls the floating-air blowing section to conduct a sheet supplying operation;

wherein the control section selects a first sheet supplying mode or a second sheet supplying mode, based on at least one of:

information of a size of the sheets;

information of a thickness of the sheets, and information of a type of the sheets, wherein the air-suction sheet conveying mechanism is actuated; and wherein the first sheet supplying mode functions in such a way that when the air-suction detecting sensor detects that no sheet has been drawn up by the air-suction sheet conveying mechanism, the control section activates the floating-air blowing section to float the sheet and conduct the sheet supplying operation, and the second sheet supplying mode functions in such a way that the control section activates the floating-air blowing section to float the sheet at each supplying operation of the individual sheets; and an image forming section which forms images on the sheet which is sent from the sheet-supplying device, wherein the sheet-supplying device and the image forming apparatus are combined through a passage.

* * * * *